US005788515A

United States Patent [19]

Mitra et al.

[11] Patent Number: 5,788,515

[45] Date of Patent: Aug. 4, 1998

[54] ELECTRICAL CONNECTOR FOR MOUNTING ON THE SURFACE OF A PRINTED CIRCUIT BOARD

[75] Inventors: Niranjan Kumar Mitra, Eindhoven, Netherlands; Jean-Marie Denis Phamvan, Chenecey-Buillon, France

[73] Assignee: Berg Technology, Inc., Reno, Nev.

[21] Appl. No.: 619,473

[22] PCT Filed: Oct. 14, 1994

[86] PCT No.: PCT/NL94/00253

§ 371 Date: May 2, 1996

§ 102(e) Date: May 2, 1996

[87] PCT Pub. No.: WO95/70865

PCT Pub. Date: Apr. 20, 1995

[30] Foreign Application Priority Data

Oct. 14, 1993 [NL] Netherlands ..... 9301779

[51] Int. Cl.[6] ..... H01R 9/09

[52] U.S. Cl. ..... 439/83; 439/733.1

[58] Field of Search ..... 439/83, 876, 748, 439/746, 77, 79, 80

[56] References Cited

U.S. PATENT DOCUMENTS

| | | | |
|---|---|---|---|
| 5,199,885 | 4/1993 | Korsunsky et al. | 439/79 OR |
| 5,395,250 | 3/1995 | Englert, Jr. et al. | 439/83 X |
| 5,461,774 | 10/1995 | Holmes et al. | 439/83 X |
| 5,588,878 | 12/1996 | Flinchbaugh et al. | 439/83 X |

*Primary Examiner*—Neil Abrams
*Assistant Examiner*—Daniel Wittels
*Attorney, Agent, or Firm*—Daniel J. Long; M. Richard Page

[57] ABSTRACT

An electrical connector (1) for mounting on the surface of a printed circuit board (4). This electrical connector includes a housing (2) made of electrically insulating material provided with a number of channels (3) for the accommodation of contact elements (5), and with contact elements (5) made of electrically conducting material which are accommodated in the channels (3). These contacts are provided with a contact end (6) for contacting a further contact element, a connection end (8) projecting beyond the bottom surface of the housing, for connecting the contact element (5) to a corresponding connection face on the surface of the printed circuit board (4). A base part extends between the contact end and the connection end, wherein the connection end (8) of the contact element (5) is provided with a connection face (9) facing away from the bottom surface of the housing. This connection face (9) is displaceable relative to said bottom surface from a predetermined mounting starting position in the direction of said surface over a distance which corresponds to the difference between the greatest and smallest distances between the bottom surface of the connector and the printed circuit board with maximum permissible curvature. The connector end (8) of the contact (5) consists of an essentially L-shaped connection element (11, 12) made of electrically conducting material which is at least partially resilient, and one leg (11) of which is connected to the base part (7) of the contact element (5) and extends in the lengthwise direction of the contact element. The other free leg (12) forms the connection face (9) facing away from the bottom surface of the connector housing. The angle formed by the legs of the connection element is either greater or smaller than 90°.

24 Claims, 10 Drawing Sheets

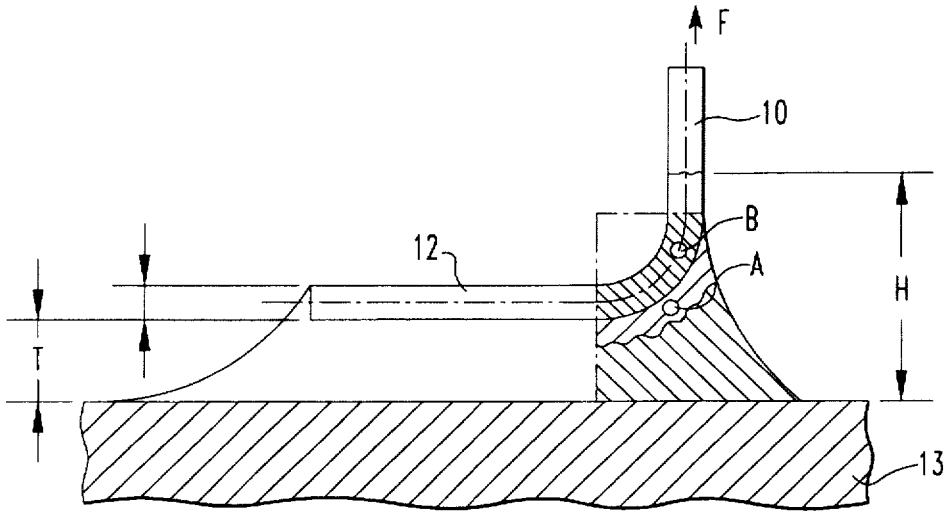
FIG.8
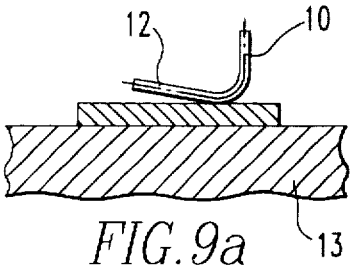
FIG.9a
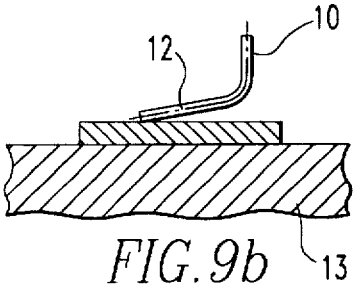
FIG.9b
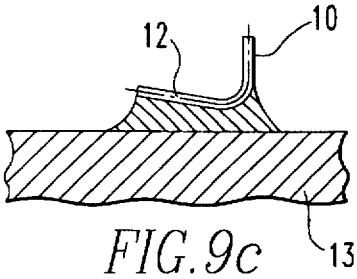
FIG.9c
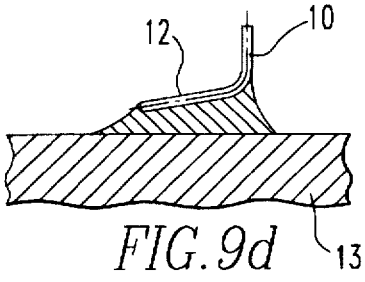
FIG.9d
FIG.12
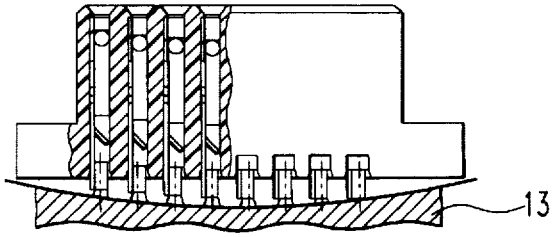

ELECTRICAL CONNECTOR FOR MOUNTING ON THE SURFACE OF A PRINTED CIRCUIT BOARD

BACKGROUND OF THE INVENTION

1. Field of the Invention

The invention relates to an electrical connector for mounting on the surface of a printed circuit board, comprising a housing made of electrically insulating material provided with a number of channels for the accommodation of contact elements, and with contact elements made of electrically conducting material which are accommodated in the channels and are provided with a contact end for contacting a further contact element, a connection end projecting beyond the bottom surface of the housing, for connecting the contact element to a corresponding connection face on the surface of the printed circuit board, and a base part extending between the contact end and the connection end.

2. Description of the Related Art

U.S. Pat. No. 4,979,903 discloses a contact element which is provided with a connection end for connecting the contact element to a corresponding connection face on the surface of a printed circuit board.

There has recently been an increase in demand for connectors with a large number of inputs/outputs, hereinafter called I/Os, on a small area of the printed circuit board. At the same time there is a need for placing the greatest possible number of components on the printed circuit board, in other words an increase in the number of desired connections by means of the connector. There is also a need for electrical shielding of these connections by providing suitable earth connections, thus by means of the connector. In order to meet the above demands, the use of both sides of the printed circuit board through the use of surface-mounted connectors and components has become a normal requirement.

In order to keep abreast of the technology, new connector designs must take into account ideas for placing the connectors on printed circuit boards by means of robots, while a large number of I/Os are necessary in order to reduce the costs. This usually results in the design of relatively long thin connectors, in particular in view of the trend towards miniaturization, i.e. the reduction in dimensions, of modern devices.

In order to make a generally known electrical connector which is provided with contact elements accommodated in channels suitable for surface mounting on a printed circuit board, the connection end of the contact element must project beyond the bottom surface of the housing, so that the contact end can make contact with a corresponding connection face on the printed circuit board.

During the mounting of such electrical connectors on printed circuit boards problems are encountered in practice, due to the fact that the printed circuit board is not completely flat and has a certain curvature or arch. The curvature of the printed circuit board varies the distance between the connection ends of the various contact elements and the corresponding connection faces on the surface of the printed circuit board. After the soldering process, poor contact resistances often occur between the connection ends of the contact elements and the corresponding connection face on the surface of the printed circuit board, in particular where the distance between them is too great, and contacting breaks can even occur in this case.

In WO 86/07204 and EP-A-0 449 570 it is disclosed that the connection end of the contact element is provided with a connection face facing away from the bottom surface of the housing, which connection face is displaceable relative to said bottom surface from a predetermined mounting starting position in the direction of said surface over a distance which corresponds to the difference between the greatest and smallest distances between the bottom surface of the connector and the printed circuit board with maximum permissible curvature.

Through placing the electrical connector on a printed circuit board with a still oermissible curvature, the connection face of the contact element facing away from the housing thereof is displaced, so that an automatic compensation for the varying distance between the connection ends of the contact elements and the corresponding connection faces on the printed circuit board is achieved.

According to WO 86/07204 the connection end of the connector element consists of an L-shaped connection element made of electrically conducting material which is at least partially resilient, and one leg of which is connected to the base part of the element and extends in the lengthwise direction of the contact element, while the other, free leg forms the connection face facing away from the bottom surface of the connector housing.

The bending point between the two legs of the L-shaped connection element usually lies very close to the bottom side (soldering side) of the connector. This bending can be achieved either by placing a metal tool at the bending point or by using a discrete opening at the side of the plastic housing with a rounded surface, in order to be able to bend the free leg therein. The individual connector elements are usually inserted from the bottom side of the housing.

On account of the material history of the free leg, the manufacturing tolerances (punching, assembling, bending etc.) and the curvature or arch of the plastic housing of the connector, a position deviation results between all free legs of the connector relative to the an imaginary contact face. This defines the term coplanarity, which must be low, for example 0.2 mm, for most applications of surface mounting of connectors. Moreover, the imaginary line connecting the soldered legs can be convex or concave as a result of the arch of the plastic.

If the connector is placed on the printed circuit on the printed circuit board, which again can have a convex or concave curvature or arch (maximum 1%), the ultimate gap between the bottom side of the free legs of the connection element and the corresponding connection face on the orinted circuit board can be greater or smaller depending on the position. It is therefore important when the connector is being designed to bear in mind the conflicting requirements of the coplanarity of the free legs and the printed circuit board arch. The problem increases in earnest when the connector length increases (not necessarily depending on the pitch).

The object of the invention is to provide an electrical connector of the type mentioned in the preamble, in which the problem of bow tolerances is obviated effectively. This object is achieved in that the angle formed by the legs of the connection element is greater or smaller than 90°.

In this case the abovementioned adaptation to the varying distance is achieved through the fact that under pressure from the printed circuit board the free leg of the L-shaped connection element can spring in the direction of the connector bottom surface, and consequently with its connection face remains in contact with the corresponding connection face on the printed circuit board, in particular if the abovementioned angle is greater than 90°. The second advantageous effect occurs during the mounting, when the connector is being pressed onto the printed circuit board during the fluxion of the soldering paste applied between the free leg of the connection element and the connection face. The flowing paste then provides the compensation for the abovementioned position deviation.

During the mounting, the connector therefore has to be placed with its bottom side on the printed circuit board, and must be pulled downwards against the printed circuit board during the fluxion process in the course of soldering and during the entire service life, so that resistance can be offered to the great forces which would otherwise occur. Such pulling devices then have to be integrated in the plastic housing of the connector. Such pulling devices also increase the manufacturing costs of the connector and make it difficult for the connector to be placed by robot on the printed circuit board. The urgency for placing pulling devices increases with:

a) the number of contacts (large connector) and where the required leg bend of the L-shaped connection element is relatively great;

b) the magnitude of the force which results from the soldered legs of the connectors not being coplanar and from curvature of the printed circuit board.

In order to overcome the abovementioned problems, the contact element is accommodated so that it is slidable in its lengthwise direction in the corresponding channel and, as it were, floats therein. In one embodiment of the invention a slide-inhibiting means is present, in order to inhibit the sliding from the mounting starting position onwards. In a further development of the invention the slide-inhibiting means is formed by the friction between the contact element and the channel accommodating it. The inhibiting force of the slide-inhibiting means is preferably greater than the spring force of the free leg of the L-shaped connection element.

In an advantageous embodiment of the invention, the slide-inhibiting means consists of a lip with an end which is resiliently connected to the base part and a free end which lies raised relative to the base part and acts under pre-tension on the adjacent wall part of the corresponding channel. The lip is preferably formed from the material of the base part.

Further developments of the contact elements according to the invention are described in a number of sub-claims.

The invention will be explained in greater detail below with reference to the drawings. In the drawings:

BRIEF DESCRIPTION OF THE DRAWINGS

FIG. 8 shows a connection element of the connectors according to FIGS. 3–7 which is bent at a right angle;

FIGS. 9*a*–9*d* show connection elements not bent at a right angle;

FIG. 12 shows a cross-section through a connector according to the invention on a bowed printed circuit board;

FIG. 1 shows an electrical connector according to the invention, consisting of a housing 2 made of electrically insulating material, for example plastic, which housing 2 is provided with channels 3 for the accommodation of contact elements, such as shown, for example, in FIGS. 3–7 on an enlarged scale. For the sake of clarity, these contact elements are not shown in the channels 3 in FIG. 1. For the part of the connector not transected, FIG. 1 does show the connection end of the contact element, which connection end is provided with a connection face facing away from the bottom surface of the housing 2.

FIG. 1 also shows a slightly bowed printed circuit board 4, the varying distance from the top side of the printed circuit board, shown as a line, to the bottom side of the connector in the lengthwise direction of the connector being illustrated for individual connectors by the respective number of pins or positions 75–10. It is clear that the maximum distance depends on the length of the connector in the case of a printed circuit board with a certain curvature, and occurs virtually in the centre of the connector. FIG. 2 shows a corresponding situation, where the top side of the printed circuit board 4 is convex. The maximum distance in this case therefore occurs at the ends of the connector.

FIG. 3 shows a preferred embodiment of the invention, in which channels 3 are provided in the housing 2 made of electrically insulating material, for the accommodation of contact elements 5. The contact element 5 consists of a contact end 6 for contacting a further contact element, a base part 7 and a connection end 8. In the case of this embodiment the contact end 6 is in the form of a socket for the accommodation of a further plug-in contact element. The connection end 8 of the contact element projects with its parts 11 and 12 beyond the housing 2 of the connector, in order to permit connection of the contact element to a connection face on the surface of a printed circuit board. The connection end 8 of the contact element 5 is provided with a connection face 9 which faces away from the bottom surface of the housing 2 and lies outside the connector housing.

In practice, a printed circuit board is never completely flat, but has a certain permissible curvature. When the connector is placed on the printed circuit board for the purpose of contacting the connection faces 9 of the contact elements 5 with corresponding connection faces on the printed circuit board, the curvature of the printed circuit board can mean that one or more connection faces do not come into contact with the connection faces on the printed circuit board. After the soldering process for contacting the corresponding connection faces, the problem found is that no contact is achieved or the contact resistance in the case of the abovementioned number of contact elements is too great.

The solution to the abovementioned problem is that the contact element is designed in such a way that the connection face 9 of the contact element 5 is displaceable from a predetermined mounting starting position relative to the abovementioned bottom surface. The displacement distance corresponds to the difference between the largest and smallest distances between the bottom surface of the connector and the printed circuit board with maximum permissible curvature.

Figure 3:
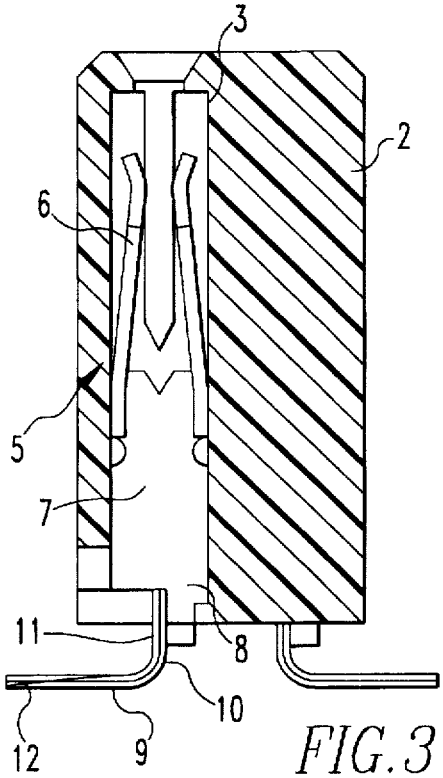
FIG. 3 shows a cross-section through the connector according to the invention at the position of a channel in which the connector element is in its mounting starting position.

In the case of the embodiment of FIG. 3 the displacement of the connection face 9 of the contact element 5 is achieved through the fact that the base part 7 of the contact element is accommodated in the channel 3 in such a way that it is slidable in its lengthwise direction. The contact element 5 thus has two extreme positions, the bottom position being the mounting starting position, in other words, prior to mounting, in particular to the placing of the connector on the printed circuit board, the contact element 5 must be in the so-called mounting starting position, for example as the result of gravity. The other extreme position is the top position, in which the free end of the contact end rests against the top collar of the channel 3.

When the connector is placed on the printed circuit board, lightly pressing the connector onto the printed circuit board causes the contact element 5 to slide upwards over a distance which depends on the curvature of the printed circuit board. The mounting starting position of the contact element is better defined if provision is made for a slide-inhibiting means for inhibiting the slide from the mounting starting position onwards in some extent. As a simple alternative, the means inhibiting the slide of the contact element 5 may be formed by the friction between the contact element 5 itself and the wall of the channel 3 resting against it.

Figure 4:
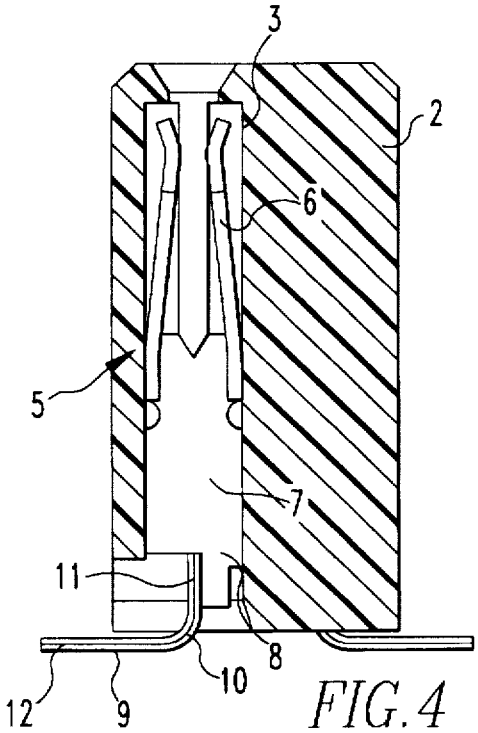
FIG. 4 shows a cross-section of a connector according to the invention at the position of a channel in which the connector element is slid out of its mounting starting position.

In FIG. 3 the contact element 5 is shown in the mounting starting position, while in FIG. 4 the abovementioned contact element 5 is shown virtually in the other extreme position. Depending on the curvature of the printed circuit board, after the connector has been pressed onto the printed circuit board the contact elements 5 lie between the abovementioned two extreme positions, said contact elements 5 being held in the correct position by means of the slide-inhibiting means.

Figure 5:
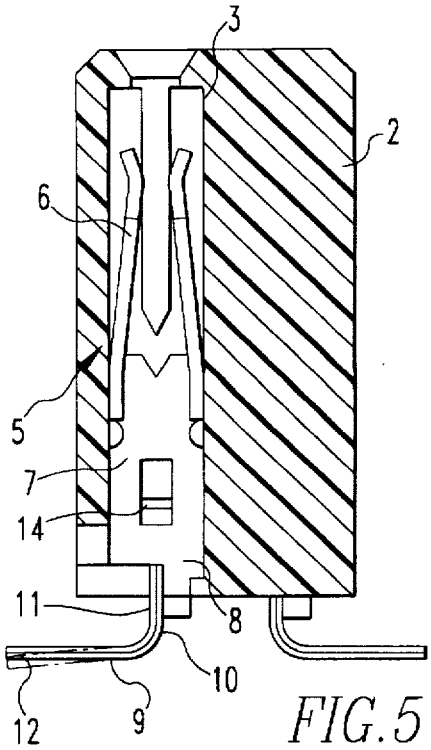
FIGS. 5 and 6 show a cross-section through a connector according to another embodiment of the invention.
Figure 6:
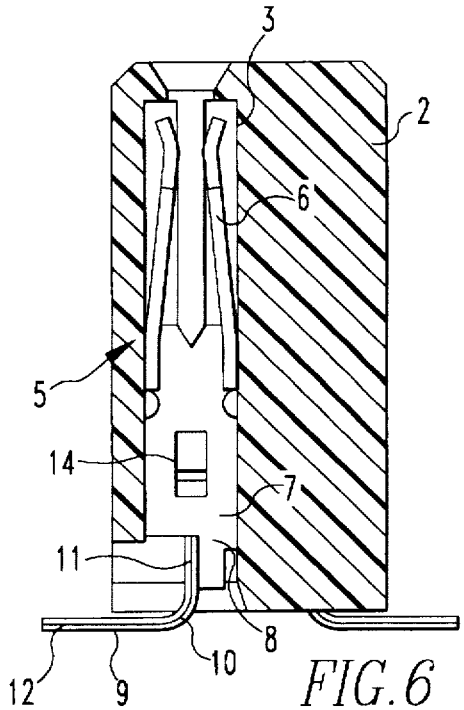
Figure 7:
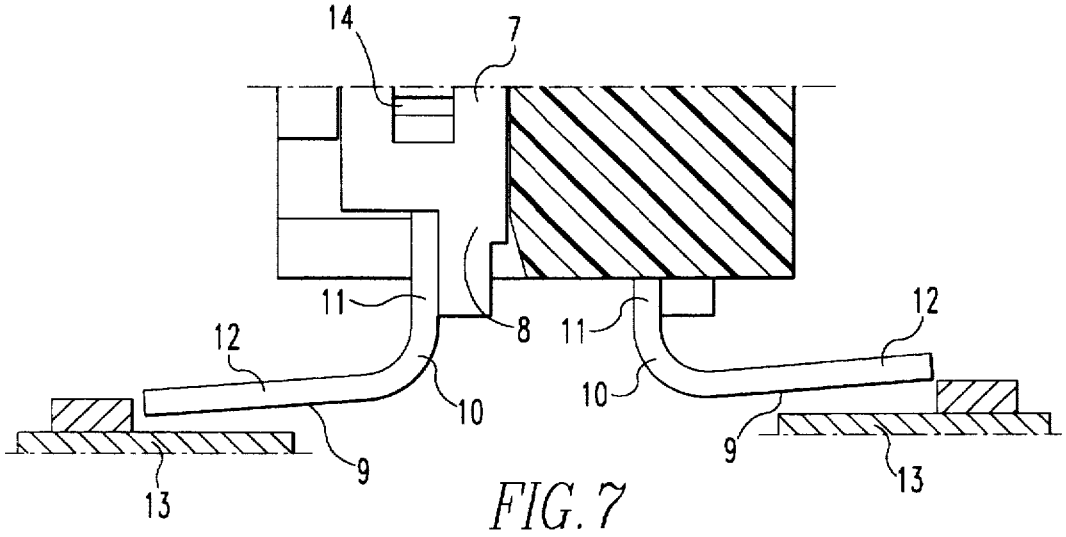
FIG. 7 shows a cross-section of a part of a connector according to the invention on an even larger scale.

FIGS. 5, 6 and 7 show an embodiment of the invention in which parts which correspond to those shown in FIGS. 3 and 5 are given the same reference numbers. A description of these parts is thus no longer necessary.

In the case of the embodiment shown in FIGS. 5, 6 and 7, for compensation of the curvature of the printed circuit board the displacement possibility of the connection face 9 of the contact element 5 is achieved through the contact end 8 of the contact element 5 being provided with an L-shaped connection element 10 made of electrically conducting material. One leg 11 of the connection element 10 is connected to the base part 7 of the contact element 5 and extends in the lengthwise direction of the contact element, while the other, free leg 12 of the abovementioned connection element 10 forms the connection face 9 facing away from the bottom surface of the connector housing 2. The angle formed by the legs 11 and 12 of the connection element 10 is greater than or smaller than 90°. Due to the fact that the L-shaped connection element 10 is made of resilient material, the connection face 9 is, as it were, displaceable in the direction of the bottom surface of the connector housing 2. If the angle formed between the legs 11 and 12 is greater than 90°, the free end of the leg 12 is preferably rounded off upwards with, for example, a radius of 0.25 mm in the case of an embodiment of a contact element of, for example, approximately 5 mm and having a free leg length of, for example, approximately 1.5 mm.

FIG. 8 shows a connection between the connection element bent through 90° and the printed circuit board in an ideal situation. For the sake of clarity, the remaining part of the connector is omitted. During placing of the connector on the printed circuit board, a soldering paste with a thickness T lies between the free leg 12 of the connection element 10 and the printed circuit board 13. FIG. 8 shows the situation after the soldering paste fluxes. After fluxion, a strip is therefore formed, hereinafter called a solder fillet, which is important for the electrical and mechanical integrity of the connection. All tensions occurring during the service life of the connection must be absorbed by this solder fillet. It can be seen clearly from FIG. 8 that the soldering paste flows upwards against the so-called heel of the connection element. Tests have shown that if the soldered connection is subjected to a vertical tensile force, the initial crack or break begins in zone A below the heel. This tensile force can be 80 to 90% of the total tensile force. In any case, if a crack begins, the electrical integrity of the connection will already be adversely affected. Therefore, the force for producing a break at the heel is a safe and realistic value for defining the quality of the surface connection. A practical value of the quality of the soldered connection is defined by the strip height H.

FIGS. 9*a* and 9*c* show the embodiment of the connection element, hereinafter called leg with heel down, in the state before and after fluxion of the solder respectively. This embodiment is suitable for connectors which are short in length.

FIGS. 9*b* and 9*d* show the corresponding situation for an embodiment of the connection element, which is hereinafter called leg with heel up, an embodiment which is suitable for longer connectors.

In both cases, heel down and heel up, the coplanarity of the leg is measured relative to the bottom side of the heel. As mentioned above, the height of the solder fillet is in both cases a good measure of the connection integrity. However, it is pointed out that in the "heel up" situation (see FIGS. 9*b* and 9*d*) an external force (for example, a pressure force or an additional mass) must be used prior to and during the fluxion of the soldering paste when the bottom side of the connector is being placed on the printed circuit board. For the leg with heel down, which can be used for connectors of shorter length (for example, up to 50 mm), the relative mass or pressure force is low. During the fluxion, the heels of all contacts first rest on the top side of the paste and then sink gradually in the direction of the printed circuit board as a result of the so-called "swimming" process in molten solder, and are subsequently aligned by the surface tension of the melt.

However, it can happen that, on account of the connector or printed circuit board having too great an arch or the legs having poor coplanarity, a gap remains between the bottom side of the connection element and the printed circuit board.

Figure 1:
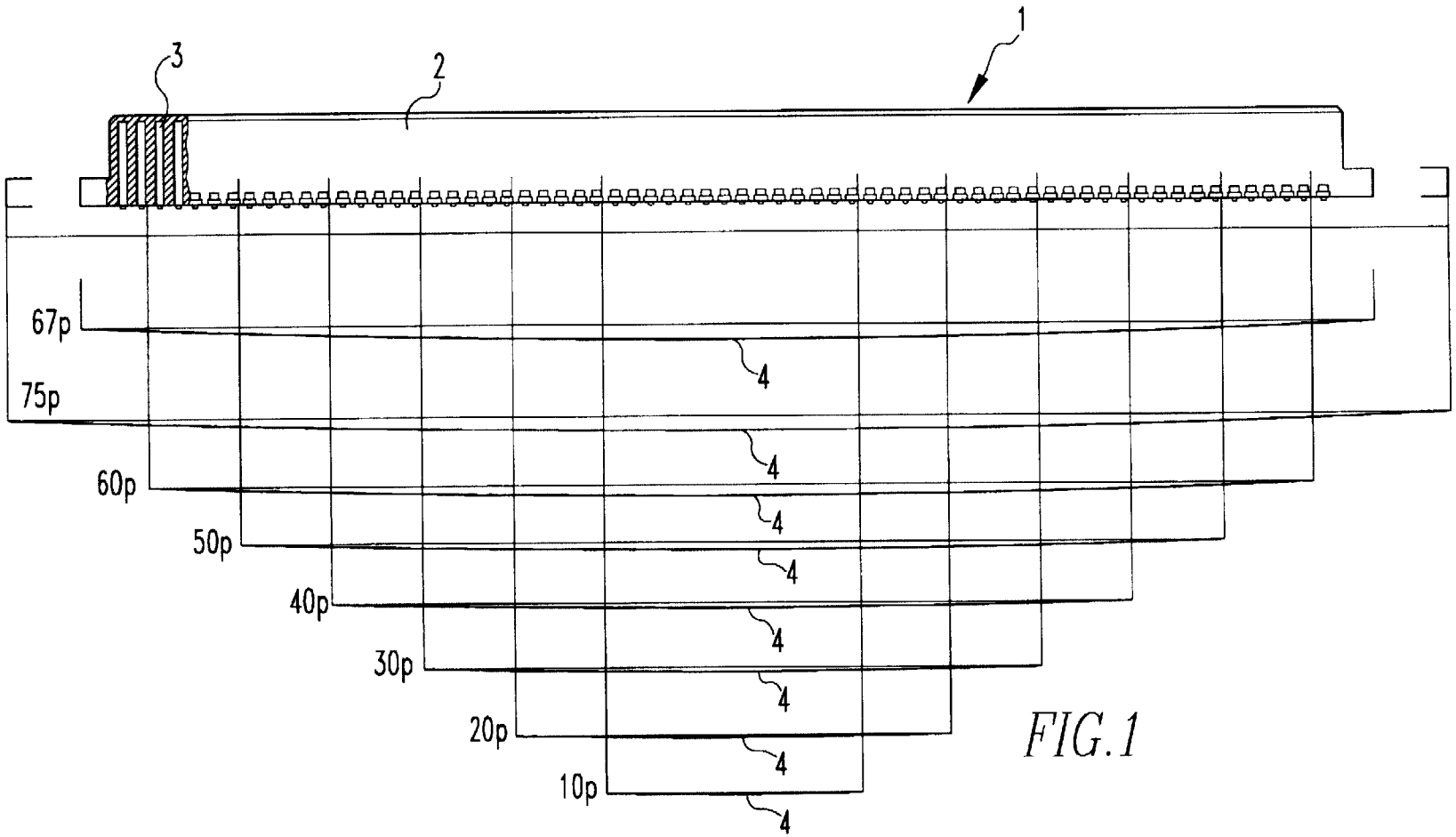
FIG. 1 shows a connector according to the invention in relation to a printed circuit board which is concave when viewed from above.
Figure 2:
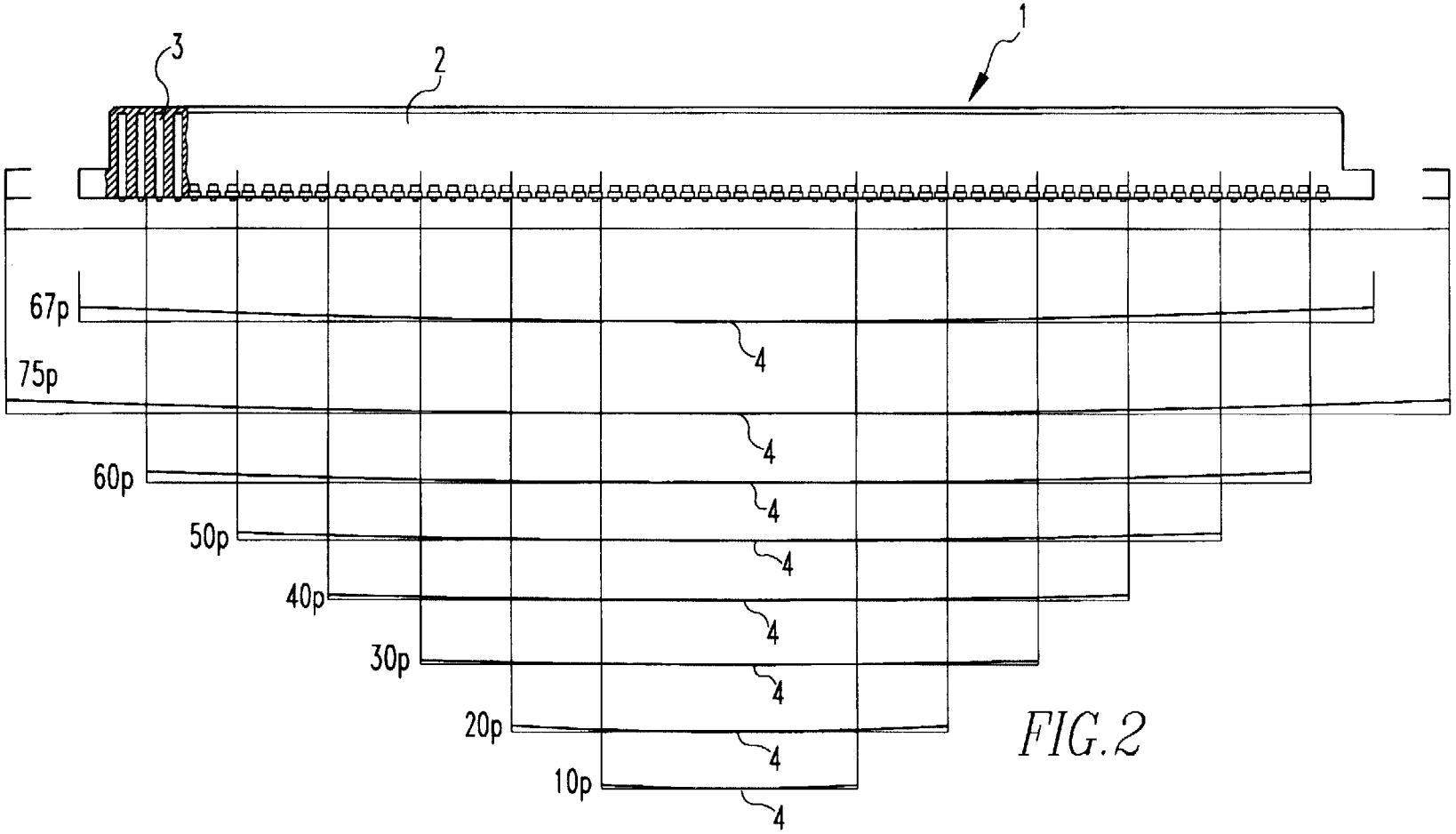
FIG. 2 shows a connector according to the invention in relation to a printed circuit board which is convex when viewed from above.

The two arched constructions are thus the connector and the printed circuit board. In practice, the maximum permissible arch for a printed circuit board is 1% of its diagonal. For surface-mounted applications this value may be kept smaller. Since the size of the printed circuit board and its applications are not fully known at the beginning when the connector is being designed, the effective printed circuit board arch can realistically be assumed to be 1% of the connector length. The coplanarity of the connection element can be assumed to be, for example, 0.2 mm (relative to the heel). The mutual curvatures of the connector and the printed circuit board may be convex or concave. FIGS. 1 and 2 show the two worst conditions which can be expected in practice for a connector with a pitch of 1.27 mm. The relative gap for each contact plate can be estimated and subsequently averaged over the number of contacts, in order to obtain an average deflection or the maximum value and position in the lengthwise direction of the connector.

It is clear that if there are more than 40 positions (for example, 50 mm), the gap can be 1 mm, which is significant but a disadvantage. This means that a significant vertical force is required (multiplied by the number of contact positions) to press the connector correctly onto the curved surface of the printed circuit board during the fluxion of the soldering paste.

Ideally, the contact elements are inserted fully into their extreme position in all channels of the connector, the coplanarity is zero, and the printed circuit board is flat. As mentioned earlier, this is never the case.

So it is clear that the resiliently arched connection element 10 can compensate only for a certain distance variation between the bottom side of the connector housing and the printed circuit board, as a result of the curvature. However, if a larger permissible curvature of the printed circuit board is maintained, it can still occur that one or more contact elements have an inadmissible contact resistance to the connection face on the printed circuit board, or a solder break occurs.

However, the greater admissible curvature can be absorbed, through the fact that the base part 7 of the contact element 5 is accommodated so that it can slide in the channel 3. The contact element 5 thus has two extreme positions, in the bottom position of which, being the mounting starting position, i.e. prior to the mounting, in particular to placing of the connector on the printed circuit board, the contact element 5 has to be in the so-called mounting starting position. The other extreme position is the top position, in which the free end of the contact end rests against the top collar of the channel 3.

When the connector is placed on the printed circuit board, the contact element 5 is slid upwards through the connector being pressed onto the printed circuit board, and provision is made for a slide-inhibiting means for inhibiting the slide from the mounting starting position. The inhibiting force of the slide-inhibiting means is preferably greater than the resilience of the free leg of the L-shaped connection element 10. For compensation of the distance variation between the bottom side of the connector and the printed circuit board, use is thus first made of the bend of the L-shaped connection element 10, following which the contact element 5 can slide in the channel 3, this slide then being inhibited by the inhibiting means. The slide-inhibiting means of the contact element 5 can be formed by the friction between the contact element 5 itself and the wall of the channel 3 resting against it.

In FIG. 3 and FIG. 5 the contact element 5 is shown in the mounting starting position, while in FIG. 4 and FIG. 6 the abovementioned contact element 5 is shown almost in the other extreme position. Depending on the curvature of the printed circuit board, the contact elements 5 lie between the two abovementioned extreme positions after the connector has been pressed onto the printed circuit board, said contact elements 5 being held in the correct position by means of the slide-inhibiting means.

FIG. 7 shows on an enlarged scale the embodiment of the L-shaped connection elements 10 of the contact element 5 of the connector 1. In the case of this embodiment, the connector consists of two rows of channels 3 in which contact elements 5 are accommodated, only one of the contact elements of one row being visible, due to the fact that the cross-section is made through the corresponding channel 3.

The next connection end 8 on the base part 7 is provided with the L-shaped connection element 10 with the two legs 11 and 12. These connection elements 10 with the legs 11 and 12 of one of the contact elements of the righthand row are also visible. The printed circuit board 13 is also shown diagrammatically. The legs 11 and 12 of the lefthand contact element 10 form an angle which is greater than 90°, while the righthand contact element is curved to an angle of less than 90° between the legs 11 and 12 of the abovementioned connection element 10.

A method of reducing the desired connection element or soldered leg deflection is not to insert the contact element fully to its extreme position in its channel. The connection element is then curved using an auxiliary tool. In one embodiment of the invention, the slide or flotation of the contact element can be selected at 0.5 mm. The configuration of the connection element can be heel down or heel up, depending on the length of the connector, and with an acceptable coplanarity. When said connector with floating contact element is now placed on the curved surface of the printed circuit board, each contact point is set vertically by means of the floating position or flexible fixing of each contact element to the corresponding channel, so that the bottom side of the heel of each connection element comes to rest on the soldering paste prior to its fluxion. However, this requires an initial vertical force in order to overcome the friction force of all contact elements in the corresponding channels. In this way the individual contact element positions in the corresponding channels are set locally, in order to compensate locally for the relative curvature of the printed circuit board.

In a specific case it is assumed that the average deviation for a connector length is 0.75 mm. If there is a connection element flotation of 0.5 mm, the current desired leg deflection for compensation is 0.75–0.5=0.25 mm. This directly means a smaller vertical force (⅓) for pressing the connector onto the printed circuit board prior to the fluxion of the soldering paste and a lower residual tension in the vertical direction after fluxion.

FIG. 12 shows the final state after mounting of the connector on the printed circuit board. It can thus be seen that, viewed in the lengthwise direction of the connector, each contact element lies in the corresponding channel in a position deviating from the extreme inserted position.

In the case of the embodiment explained above the slide of the contact element is inhibited by means of friction. However, the inhibiting means can also be achieved in another way.

In the case of the embodiment of the connector according to the invention shown in FIGS. 5–7, the means inhibiting the slide of the contact element 5 is formed by a lip 14, one end of which is connected to the base part 7 of the connector element 5, while the free end of the lip 14 projects beyond the periphery of the base part. The resilience of the lip means that it acts under pre-tension on the adjoining wall part of the corresponding channel 3.

The lip is preferably formed from the material of the base part, for example through cutting out and bending.

Embodiments of said lip are described below with reference to FIGS. 13 to 16.

Figure 10:
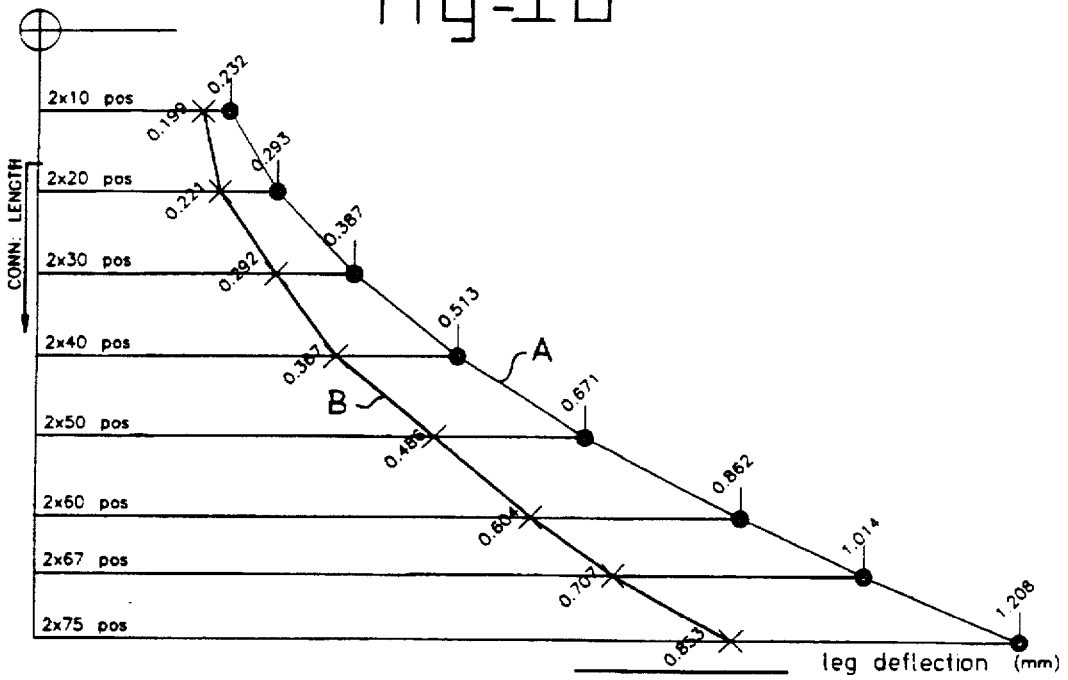
FIG. 10 shows a graph of the leg bend as a function of the connector length.

In FIG. 10 the connector length, expressed in the number of connector positions or contact elements, is plotted along the Y-axis. The leg deflection of the L-shaped connection element 10 of the connector element 5 is plotted in millimetres along the X-axis. Curve A applies to the top deflection in the case of a bowed concave printed circuit board, and curve B to the average deflection in the same circumstances. These curves apply to a printed circuit board arch of 1% and a coplanarity of 0.2 mm.

For a connector with two rows of 50 positions in the abovementioned circumstances there is therefore a leg deflection of 0.671 mm near the centre of the connector.

Figure 11:
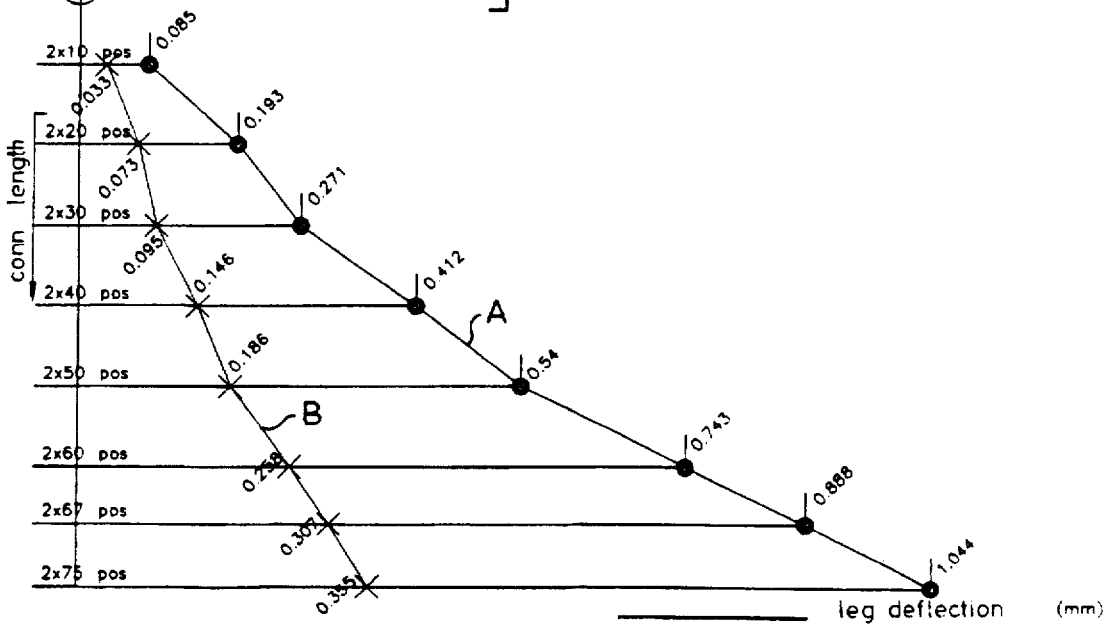
FIG. 11 shows a similar graph to that in FIG. 10.

FIG. 11 applies to a convex bowed printed circuit board under the same circumstances as FIG. 6. FIGS. 6 and 7 thus relate to FIGS. 1 and 2 respectively.

A description follows of a number of preferable embodiments of the contact element with a lip-shaped retaining element or retaining elements 16 which inhibit the slide thereof.

Figure 13:
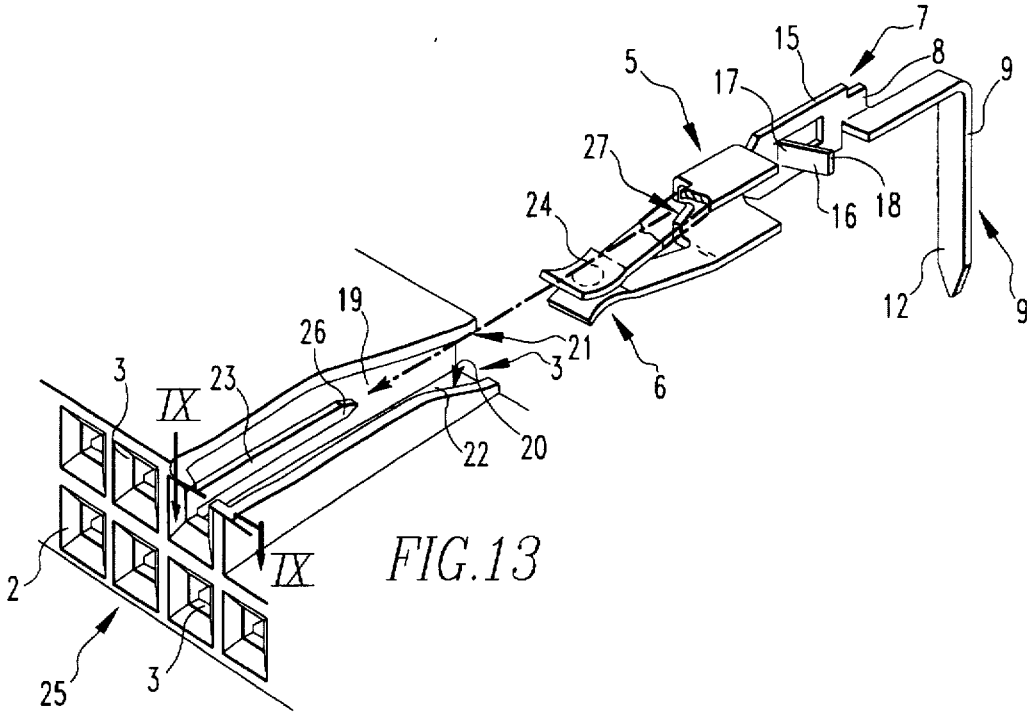
FIG. 13 shows diagrammatically in perspective a part of a connector and a contact element according to the invention, partially disassembled.

FIG. 13 shows partially a housing 2 made of electrically insulating material, for example plastic, provided with several square, elongated channels 3 for the accommodation of a contact element such as, for example, the contact element 5 made of electrically conducting material shown in FIG. 7.

This contact element 5 is made up of a contact end 6, in the form of a socket, and a connection end 8 provided with a connection element 10 which is L-shaped and is made of electrically conducting material. The free leg 12 has a connection face 9 which is used for soldered mounting on a printed circuit board with a corresponding connection face (not shown). Between the contact end 6 and the connection end 8 extends a base part 7, in the form of an elongated flat plate 15, to the ends of which the contact end 6 and the connection end 8 and the connection element 10 respectively are connected, and with a lip-shaped retaining element 16 according to the invention extending from the face of the base part.

In the embodiment shown, the lip-shaped retaining element 16 is formed by cutting and bending out of the plate 15 of the base part 7. The lip-shaped retaining element 16 is in this case resiliently connected to the base part 7, with its end 17 adjacent to the contact end 6 fixed, while the free end 18 of the retaining element 16 lies raised relative to the plate 15 of the base part 7 adjoining the connection end 8.

Figure 14:
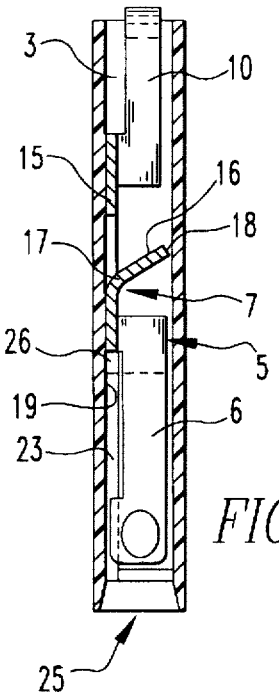
FIG. 14 shows diagrammatically a cross-section view of a contact element accommodated in the housing of the connector according to FIG. 13.

FIG. 14 shows a cross-section view along the line II—II through a channel 3 of the connector according to FIG. 13, with the contact element 5 mounted therein.

It can be seen clearly that the lip-shaped retaining element 16 according to the invention extends in the channel 3 over the full cross-section at an angle relative to the lengthwise direction thereof. The flat plate 15 of the base part 7 in this case lies against the boundary wall 19 of the channel 3, while the free end 18 of the lip-shaped retaining element 16 acts upon the boundary wall 20 of the channel 3 lying opposite the boundary wall 19.

During placing of the connector on the printed circuit board and contacting of the contact end 8, in particular the L-shaped connection element 10 of the contact element 5, the retaining element 16 will try to form a larger angle relative to the plate 15 of the base part 7, with the result that the plate 15 is pressed with more force against the wall 19 of the channel 3, in order to provide the required retaining force in the plug-in direction of the contact element 5. The force with which the contact element 5 is retained by means of the lip-shaped retaining element 16 in the channel 3 of the housing can be relatively slight, but sufficient to prevent the contact element 5 from springing out of the channel through shocks or impacts.

The force with which the contact element 5 is retained in a channel 3 is particularly advantageous in the case of contact elements with the connection element 10 to be soldered. Through this force the thermal contact between the base part 7 and the boundary wall 19 of the channel 3, and also the thermal contact between the free end 18 of the retaining element 16 and the boundary wall 20 of the channel, is relatively poor, with the result that relatively little heat is transferred to the boundary walls 19, 20. Due to the absence of (high) mechanical pressure on the walls 19, 20, the latter are also less likely to undergo thermal deformation. This is advantageous in particular in the case of connectors of small dimensions, for example with channels 3 arranged in rows and having a pitch distance of, for example, 1 mm between the channels in a row and a pitch distance of 1.27 mm between individual rows, because the walls 19, 20 are relatively thin here and can consequently be damaged through a relatively small amount of heat. Compared with retention hooks or other retention elements exerting pressure on the channel walls, the lip-shaped retaining element 16 according to the invention has the advantage that in the event of any thermal deformation of the boundary walls 19, 20, there is little or no effect on the retention force, due to the inherent spring action of the retaining element 16.

In the case of bowed printed circuit boards, after the spring of the connection element 10 the contact element is slid in the channel in the direction of the connection end 6, which slide is inhibited by the retaining element 16. The contact element then remains in the correct position.

It can also be seen clearly from FIG. 14 that the lip-shaped retaining element 16 according to the invention utilizes the available cross-section of the channel 3 as fully as possible, with the result that even in the case of the, for example, abovementioned small dimensions of a connector, or contact element, a lip-shaped element of sufficient strength can be provided. It is, of course, also possible to use two or more lip-shaped retaining elements 16 which, for example, all act upon the boundary walls 19, 20 of a channel 3, or also on the boundary walls 21, 22 of a channel 3, in combination with a, for example, L-shaped or U-shaped base part 7 (see FIG. 8). Of course, these retaining elements 16 can also extend in a channel 3 at various angles relative to the lengthwise direction thereof.

Figure 15:
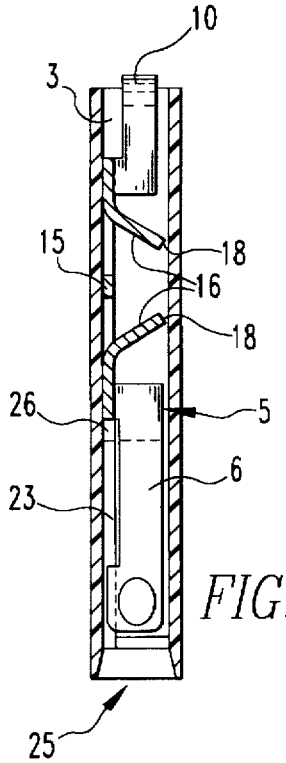
FIG. 15 shows diagrammatically a cross-section view of an assembled contact element in a housing according to FIG. 13.
Figure 16:
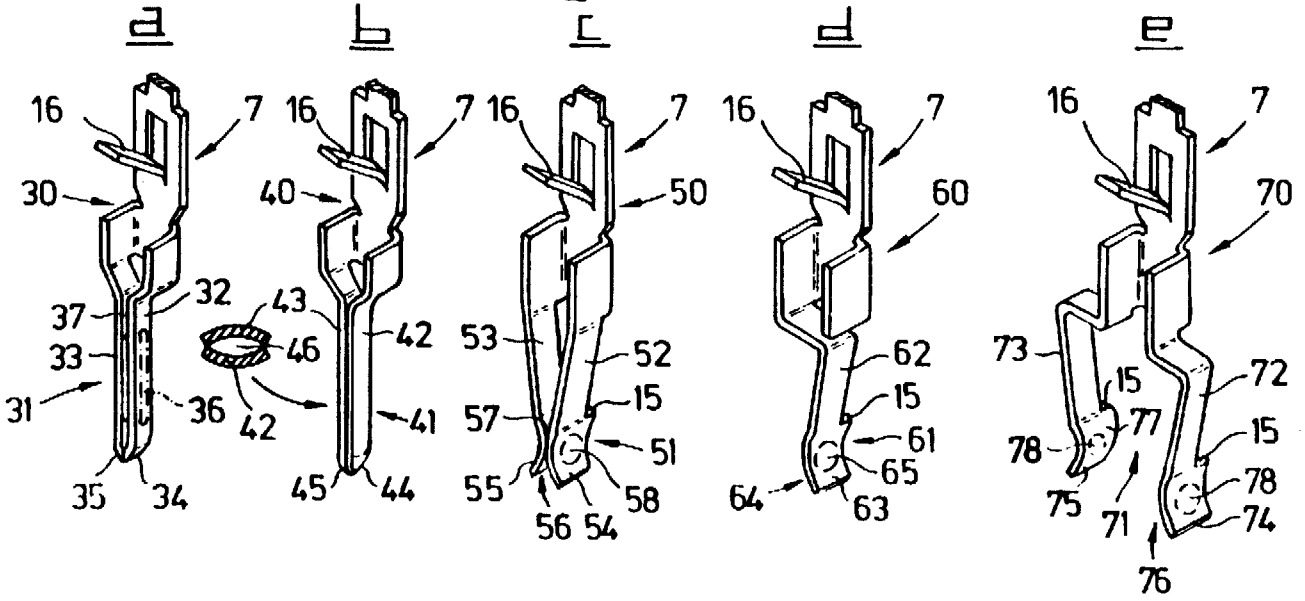
FIGS. 16*a*–16*e* show diagrammatically in perspective various embodiments of contact ends of contact elements according to the invention.

FIG. 15 shows a cross-section view of a contact element according to the invention, in a channel 3 of the housing 2 corresponding to FIG. 13, provided at one end with a socket 6 and equipped at the other end with a connection element 10 and two lip-shaped retaining elements 16, the free ends 18 of which lie opposite each other.

The lip-shaped retaining elements 16 according to the invention also have the advantage that by using a mandrel or the like, it is easy to remove the contact elements from a channel of the housing, simply by pushing the lip-shaped retaining element 16 in the direction of the corresponding base part 7. Such a mandrel can advantageously be used for assembling with minimal force a contact element in a channel 3, which is particularly advantageous in the case of contact elements of reduced dimensions, for example contact elements which are relatively long and thin, which in this way can be inserted into the housing without the risk of deformation. For the assembly of a connector with contact elements of the type shown in FIG. 15, it is also necessary to use a mandrel which acts upon the retaining elements 16.

FIGS. 16*a*–16*e* show various embodiments of contact ends of contact elements provided with a base part 7 according to the invention.

FIG. 16*a* shows a contact element 30 with a contact end in the form of a plug 31, made up of two elongated flat sheet parts 32, 33 lying opposite each other and extending from the base part 7, with one end firmly fixed thereto. The plate parts 32, 33 are designed with their respective free ends 34, 35 tapering towards each other. In order to increase the rigidity of the plug 31, bulges 36 can be provided in the plate parts, which bulges 36 are shown by dashed lines and extend in the cross-section 37 bounded by the plate parts 32, 33.

FIG. 16*b* shows a further embodiment of a contact element 40, with a contact end in the form of a plug 41. Unlike the embodiment of FIG. 11*a*, the plug is made up of curved plate parts 42, 43, as shown enlarged in cross-section. At their free ends 44, 45, the two plate parts 42, 43 are tapered in a cone shape towards each other. Instead of the elliptical cross-section 46 shown, the two plate parts 42, 43 can bound any other cross-section, for example a circular cross-section.

The space bounded by the respective plate parts 32, 33 and 42, 43, particularly in the case of contact elements provided with a soldered connection end, acts as a reservoir for the collection of soldering flux. This prevents the (relatively small) contact faces on the outward facing surfaces of the plate parts 32, 33 and 42, 43 from accidentally becoming polluted with soldering flux, which results in an increase in the contact resistance on contacting of a further connector. The retaining element 16 according to the invention also acts as a barrier against an undesired flow of soldering flux from the connection end to the contact end of a contact element.

FIG. 16*c* shows a contact element 50, provided with a contact end in the form of a socket 51, corresponding to the socket 6 shown in FIG. 8. The socket 51 is formed by two elongated flat or curved plate parts 52, 53 lying opposite each other and extending from the base part 7, with one end firmly fixed thereto. The facing faces 56, 57 of these plate parts 52, 53 at the respective free ends 54, 55 form a contact point for contacting a further contact element, for example the contact element according to FIG. 11*a* or 11*b*. In the embodiment shown, the contact points in the plate parts 52, 53 are bulges 58 provided near the free ends 54, 55, and the corresponding free ends are also curved in such a way that the bulges 58 project from the curved surface. The use of bulges 58 is not necessary per se, nor is making the free ends 54, 55 of the plate parts 52, 53 curved. The bulges 58, 59 have the advantage that the socket 51 is less sensitive to tolerance differences in plugs to be contacted therewith, while the abovementioned curvature of the free ends 54, 55 facilitates the accommodation of a plug.

FIG. 16*d* shows a contact element 60 according to the invention, but provided with a single elongated plate part 62 forming a contact finger 61. At its free end 63 the plate part 62 forms a contact point 64 which has a bulge 65, corresponding to that of the contact element 50.

FIG. 16*e* shows a contact element according to the invention designed in a corresponding way to that in FIG. 11*c*, and is provided with a socket 71 for contacting contact faces on the edge of a substrate, for example a printed circuit board, a credit card or an admission pass card, provided with contact faces produced on an edge. The socket is again formed from flat plate parts 72, 73 with free ends 74, 75 which form contact points 76, 77 provided with bulges 78, corresponding to the embodiment according to FIG. 11*c*.

As illustrated in FIG. 13, the channels 3 can be provided with lobe-shaped or rib-shaped elements 13 interacting with one or more lug-shaped elements 24 disposed near the free ends of a socket 6, 51, 61, 71 and extending in the lengthwise direction of the plate parts in question, for positioning the plate parts 52, 53; 62; 72, 73 in a channel 3. In the embodiment shown, the plate parts 52, 53; 62; 72, 73 in question are pre-positioned over a distance relative to each other by the rib-shaped element 23 by means of the lug-shaped elements 24, as a result of which the plug-in force for contacting a further connector is reduced.

As can be seen clearly from FIG. 13, for centring the contact element 5 in a channel 3 the rib-shaped element 23 is designed so that it tapers off at its end 26 facing away from the contact side 25 of the housing 2, in such a way that in the assembled state said end 26 acts upon a V-shaped recess 27 of the contact element 5.

The contact elements according to the invention can advantageously be formed in one piece by, for example, punching them out of a flat sheet made of electrically conducting material, and subsequently folding. Unlike, for example, solid plugs, the plugs according to the invention made from the plate parts can be made more accurately and with a smoother contact surface.

It will be clear that the invention is not restricted to a lip-shaped retaining element of the type shown, or a two-sided connector of the type shown, but that for a person skilled in the art obvious deviations and additions are possible, for example a lip-shaped retaining element with a rounded free end.

Figure 17:
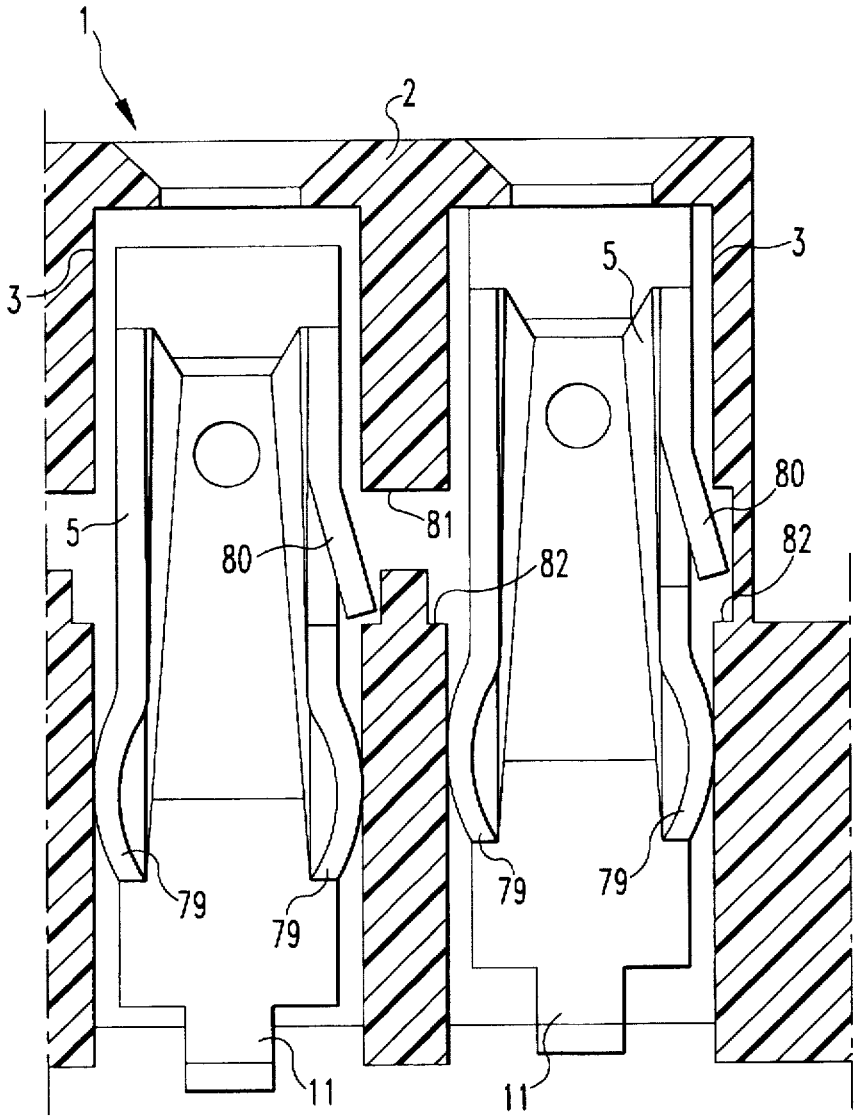
FIG. 17 shows a cross-section of a part of a practical advantageous connector according to the invention.
Figure 18:
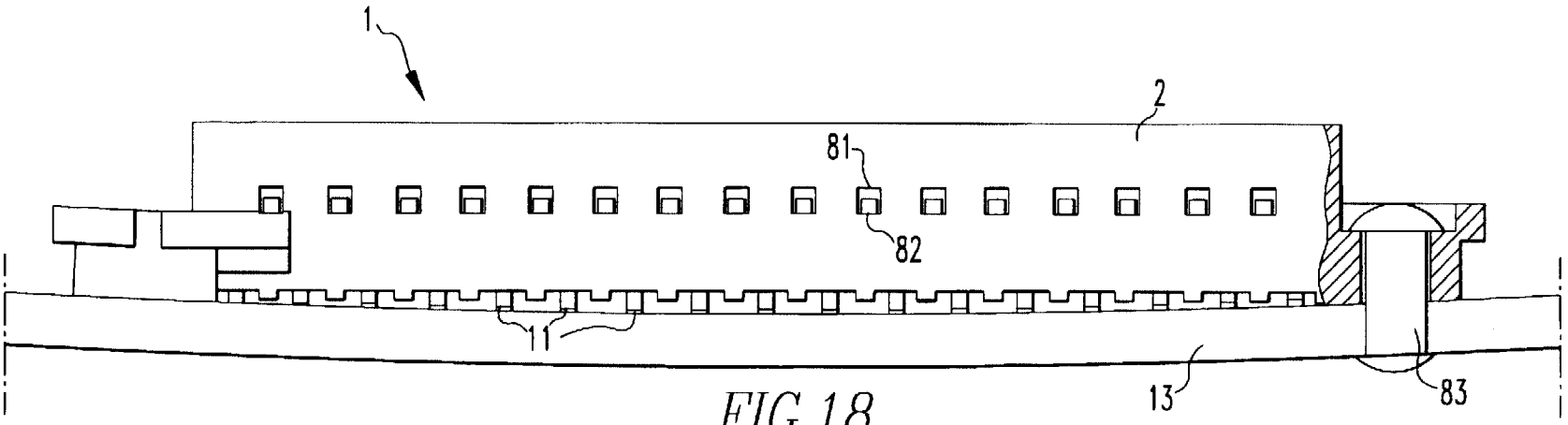
FIG. 18 shows a connector according to FIG. 17 mounted on a printed circuit board which is concave when viewed from above.
Figure 19:
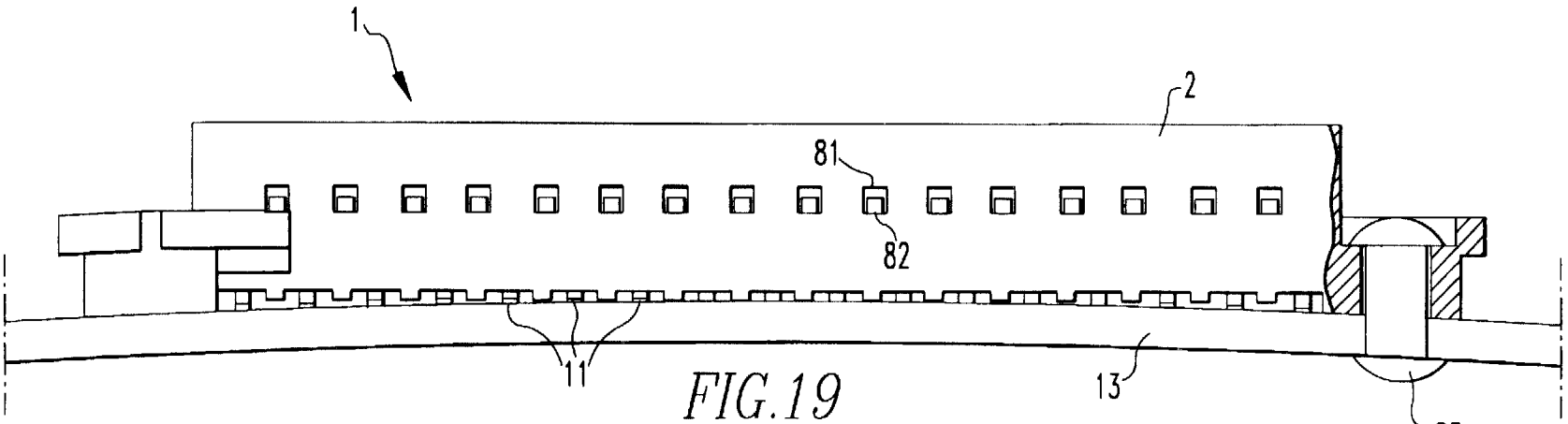
FIG. 19 shows a connector according to FIG. 17 mounted on a printed circuit board which is convex when viewed from above.

A particularly practical and advantageous embodiment of the invention is shown in FIGS. 17, 18 and 19. The problems encountered through the lack of coplanarity of the connector and the arch of the printed circuit board are overcome here in a simple and advantageous way. In the case of this embodiment the principle according to the invention of the floating contact element is used, thereby achieving the advantage that both during and after soldering of the connector on the printed circuit board mechanical stresses on the solder are minimized. The result is therefore a connector mounted with reliable soldered points on a printed circuit board. FIG. 17 shows a part of a connector 1 with the plastic housing 2. In this plastic housing 2 are channels 3, in which the contact elements 5 are slidably accommodated and, as it were, float therein. Contact element 5 bounds an opening for accommodating from the top a further contact element (not shown) which must be electrically connected by means of contact element 5 to a connection face on the printed circuit board. For this purpose, the contact element 5 is provided with a connection element 11, for example in the form of a leg bent to an L-shape. The lefthand contact element 5 is shown in the bottom extreme position, i.e. the mounting starting position, but the righthand contact element 5 is shown in the other extreme position, in which it is resting against the top wall of the channel 3.

The contact element 5 is also provided with elevations 79 which are resilient or are resiliently connected to the contact element 5. Due to the fact that these elevations 79 are resilient and rest with a predetermined pre-tension against the wall of the channel 3, a certain force must be exerted in the axial direction of the contact element 5 in order to slide said contact element in the channel 3.

The contact element 5 is also provided with a lip 80, which is preferably made by punching and bending it out of the side wall material of the contact element 5. The free end of the lip 80 projects into a recess 81 in the wall of the channel 3. For production reasons, this recess is formed by a through-running passage at right angles to the lengthwise direction of the connector 1. Through the shape of the recess 81, in particular the collar 82, the bottom extreme position—the mounting starting position—is well-defined, and the contact element 5 cannot fall out of the channel 3 during transportation of the connector.

A connector 1 mounted on a printed circuit board 13 is shown in FIG. 18. In the case of this example the printed circuit board 13 is concave when viewed from the top. It can be seen clearly from FIG. 18 that the legs 11 of the contact elements project more or less beyond the plastic housing 2, depending on the position of the contact element in the connector 1 and the amount of curvature of the printed circuit board 13. Prior to the mounting, all contact elements are retained and defined in the bottom extreme position in the plastic housing by the elevation 79 or the lip 80. Placing the connector 1 on the printed circuit board 13 automatically produces a compensation for the deviation from the coplanarity of the connector and the unavoidable arch of the printed circuit board 13. No forces occur on the soldering paste either during or after the soldering process. The connector 1 is fixed on the printed circuit board by means of, for example, a rivet 83.

FIG. 19 shows a connector 1 mounted on a printed circuit board 13 which is convex when viewed from the top. Here again, it is clear that the problems of the lack of coplanarity of the connector and the arch of the printed circuit board 13 have been overcome.

We claim:

1. Electrical connector (1) for mounting on the surface of a printed circuit board (4) having a surface, comprising a housing (2) having a bottom surface and made of electrically insulating material provided with a number of channels (3) for accommodation of contact elements (5), and with contact elements (5) made of electrically conducting material which are accommodated in the channels (3) and are provided with a contact end (6) for contacting a further contact element, a connection end (8) projecting beyond the bottom surface of the housing, for connecting the contact element (5) to a corresponding connection face on the surface of the printed circuit board (4), and a base part extending between the contact end and the connection end, wherein the connection end (8) of the contact element (5) is provided with a connection face (9) facing away from the bottom surface of the housing, which connection face (9) is displaceable relative to said bottom surface from a predetermined mounting starting position in toward said surface over a distance which corresponds to the difference between the greatest and smallest distances between the bottom surface of the connector and the printed circuit board with maximum permissible curvature, wherein the connector end (8) of the contact (5) consists of an essentially L-shaped connection element (11, 12) made of electrically conducting material which is at least partially resilient, and one leg (11) which is connected to the base part (7) of the contact element (5) and extends in a lengthwise direction of the contact element, while the other, free leg (12) forms the connection face (9) facing away from the bottom surface of the connector housing, characterized in that the angle formed by the legs of the connection element is different from 90°.

2. The connector according to claim 1, characterized in that a slide-inhibiting means for the contact element (5) is formed by friction between the contact element (5) and the corresponding channel (3).

3. The connector according to claim 1, characterized in that the inhibiting force of the slide-inhibiting means is greater than the spring force of the free leg (12) of the L-shaped connection element (11, 12).

4. The connector according to claim 1, characterized in that a slide-inhibiting means for the contact element (5) consists of a lip (14) with an end which is resiliently connected to the base part (7) and a free end which lies raised relative to the base part and acts under pretension on the adjacent wall part of the corresponding channel (3).

5. The connector according to claim 4, characterized in that the lip (14) is formed from the material of the base part (7).

6. The connector according to claim 5, in which the channels (3) fully or partially have an essentially rectangular or square cross-section, and the base part (7) comprises a flat plate part (15) from which the lip-shaped element (14) is formed, which flat plate part (15) acts upon a flat wall part (19) of the corresponding channel (3), and in which the free end of the lip-shaped element (14) acts upon a further flat wall part (20) of the channel (3) lying opposite the above-mentioned wall part (19).

7. The connector according to claim 4, in which the base part (7) is provided with several lip-shaped elements.

8. The connector according to claim 7, in which the lip-shaped elements project at various angles relative to the base part.

9. Connector according to claim 4, in which one or more lobe-shaped or rib-shaded elements (13) for positioning the contact end of a corresponding contact element are provided.

10. A contact element provided with a contact end (8), a connection end and a base part (7) according to claim 4, characterized in that the contact end (8) is a plug (41), made up of two elongated plate parts (42, 43) lying opposite each other and extending from the base part, with one end firmly fixed thereto, which plate parts (42, 43) at least at their free end are tapered towards each other.

11. The contact element according to claim 10, in which the two plate parts (42, 43) are flat and bound a rectangular cross-section.

12. The contact element according to claim 10, in which the two plate parts (42, 43) are curved and bound a cylindrical cross-section.

13. The contact element according to claim 10, in which the free ends of the plate parts (42, 43) are tapered in a cone or pyramid shape.

14. The contact element according to claim 10, in which bulges facing each other are provided in a part of the two plate parts (42, 43) lying between the fixed and the free end.

15. The connector according to claim 4, having a contact element provided with a contact end, a connection end and a base part, characterized in that the contact end is in the form of a socket (51) formed by two elongated plate parts (52, 53) lying opposite each other and extending from the base part (71), and resiliently connected thereto with one end firmly fixed, of which plate parts (52, 53) the facing faces are provided at their free end with a contact point for accommodating between them further contact element.

16. The connector according to claim 4, having a contact element provided with a contact end, a connection end and a base part, characterized in that the contact end is made up of an elongated plate part (62) extending from the base part (7), with one end firmly fixed resiliently thereto, of which plate part (62) a face is provided at its free end with a contact point (64) for contacting a further contact element.

17. The connector according to claim 15, having a contact in which the contact points (64) are bulges (65) provided in the plate parts (62).

18. The connector according to claim 15, having a contact in which the elongated plate parts (52, 53) at their free end are provided with at least one lug-shaped element (24) extending in the lengthwise direction, for positioning the corresponding plate parts (52, 53; 62; 72, 73) in the assembled position.

19. The connector according to claim 15, having a contact in which the elongated plate parts (52, 53) are curved at their free end, and in which the contact points lie on the convex side of the curved face of the plate parts.

20. The contact element according to claim 10, made in one piece from a flat sheet made of electrically conducting material.

21. The connector according to claim 1, characterized in that the angle formed by the legs of the connection element is greater than 90°.

22. The connector according to claim 1, characterized in that the angle formed by the legs of the connection element is less than 90°.

23. An electrical connector (1) for mounting on the surface of a printed circuit board, comprising a housing (2) having a bottom surface made of electrically insulating material provided with a plurality of channels (3) for accommodation of a plurality of contact elements (5), and with said contact elements (5) made of electrically conducting material accommodated in the plurality of channels (3) and provided with a contact end for contacting a further contact element, a connection end projecting beyond the bottom surface of the housing, for connecting each of the contact elements to a corresponding connection face on the surface of the printed circuit board, and a base part extending between the contact end and the connection end, characterized in that the connection end of each of the contact elements (5) is provided with a connecting face facing away from the bottom surface of the housing, in that each of the contact elements is slidable in the lengthwise direction in the channel from a predetermined mounting starting position over a distance which corresponds to the difference between the largest and smallest distances between the bottom surface of the connector and the printed circuit board with maximum permissible curvature, in that each of the contact elements is provided on opposite side walls and near the connection end with elevations (79) which project beyond the corresponding side walls, 15 made so that they are resilient at right angles thereto, and rests with a predetermined pre-tension against the adjacent channel (3) side wall, and in that each of the contact elements has on at least one side wall a lip (80), the free end of which projects beyond said side walls and lies in a recess (81) of the channel (3) wall, while in the mounting starting position the free end of the lip (80) rests against a collar (82) on the bottom side of the recess.

24. A connector according to claim 23, characterized in that the recesses (81) in the channel (3) walls of the connector housing (2) are formed by bores in the connector housing (2) running at right angles to the lengthwise direction of the connector.

* * * * *